US008066531B2

(12) United States Patent
Kanatsu

(10) Patent No.: US 8,066,531 B2
(45) Date of Patent: Nov. 29, 2011

(54) MICROPHONE OUTPUT CONNECTOR

(75) Inventor: Ryo Kanatsu, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 179 days.

(21) Appl. No.: 12/649,694

(22) Filed: Dec. 30, 2009

(65) Prior Publication Data

US 2010/0184328 A1 Jul. 22, 2010

(51) Int. Cl.
*H01R 13/58* (2006.01)

(52) U.S. Cl. ..... 439/620.22; 439/607.34

(58) Field of Classification Search ..... 439/607.07, 439/95, 106, 607.34, 607.47, 607.46, 903
See application file for complete search history.

(56) References Cited

U.S. PATENT DOCUMENTS 7,063,546 B2 * 6/2006 Akino ..... 439/620.21
7,104,844 B2 * 9/2006 Akino ..... 439/620.21
7,517,234 B2 * 4/2009 Akino ..... 439/106
7,540,780 B2 * 6/2009 Akino ..... 439/620.14

FOREIGN PATENT DOCUMENTS

JP 2005-311752 11/2005

* cited by examiner

*Primary Examiner* — Tulsidas C Patel
*Assistant Examiner* — Travis Chambers
(74) *Attorney, Agent, or Firm* — Whitham Curtis Christofferson & Cook, PC

(57) ABSTRACT

A microphone output connector is of a three-pin type. A cylindrical connector housing and a first pin are installed at an end of a conductive microphone case of a microphone to be electrically connected to the microphone case. The microphone output connector includes a shield cover penetrated by three pins and covering a surface of the connector base. The shield cover partly extends to cover a portion of the connector base at which a thread is screwed in so that the shield cover is pressed against an inner surface of the cylindrical connector housing by the thread. The shield cover is pressed against the inner surface of the cylindrical connector housing by the connector base at a side of the connector base opposite to the position at which the thread is screwed in.

7 Claims, 6 Drawing Sheets

MICROPHONE OUTPUT CONNECTOR

BACKGROUND OF THE INVENTION

1. Field of the Invention

The present invention relates to a microphone output connector, and more specifically, to a technique for protecting a microphone case against invasion by a high-frequency electromagnetic wave generated by a cellular phone or the like, through the output connector. The present invention is advantageously used for, for example, a capacitor microphone output connector.

2. Description of the Related Art

Capacitor microphones incorporate an impedance converter such as a field effect transistor (FET) for very high impedance of a microphone unit. The capacitor microphones generally use a phantom power source. Microphone sound signals are output via a balanced shielded cable for the phantom power source.

A microphone case (a microphone grip in a case of a handled microphone) is installed with a three-pin type output connector for a connection with the balanced shielded cable (see, for example Japanese Patent Application Publication No. 2005-311752). FIG. 5 is a front view of an output connecter according to Japanese Patent Application Publication No. 2005-311752 extracted from a microphone case. FIG. 6 is a cross sectional view of the output connector installed in the microphone case.

According to the invention disclosed in Japanese Patent Application Publication No. 2005-311752, this output connector 10 includes a disk-shaped connector base 11 made of an electric insulator such as a polybutadiene terephthalate (PBT) resin. The connector base 11 has three pins, namely a first pin E of earthing, a second pin SH on a hot signal side, and a third pin SC on a cold signal side and the three pins are penetratingly installed by press fitting to the connector base 11.

In the case of the handheld microphone, the microphone connector 10 is installed in a cylindrical connector housing 20 screwed on an end of a microphone grip as shown in FIG. 6. The microphone grip and the cylindrical connector housing 20 are made of metal such as brass and also function as a shield case for electric parts incorporated therein.

When an intense electromagnetic wave is applied to a microphone or a microphone cable while the microphone cable (balanced shielded cable) connected out of a phantom power source (not shown) is connected to the output connector 10, the electromagnetic wave may enter the microphone through the output connector 10. In this case, the electromagnetic wave is demodulated by an impedance converter and output by the microphone as noise of an audible frequency.

A conventional technique known before the invention disclosed in Japanese Patent Application Publication No. 2005-311752, can effectively inhibit invasion by normal broadcasting waves, for example, electromagnetic waves of HF, VHF, UHF, or the like. However, the recent prevalence of cellular phones or the like has increased opportunities to use electromagnetic waves of higher frequencies near the microphone.

In the invention disclosed in Japanese Patent Application Publication No. 2005-311752, a male thread 12 is installed in the connector base 11 to electrically connect the first pin E for earthing to the cylindrical connector housing 20. The male thread 12 is housed in a thread housing hole 13 drilled in the connector base 11 in a radial direction. As shown in FIG. 6, a screwdriver (not shown) is inserted through a round hole 21 drilled in the cylindrical connector housing 20. The male thread 12 is rotated and pulled out using the screwdriver from the connector base 11. Thus, the male thread 12 is touched against the periphery of the round hole 21. A print circuit board 100 and a shield cover 200 are installed on an inner surface (which faces the interior of the microphone) side of the connector base 11 in order to protect the interior of the microphone (the interior of the microphone case) against the invasion by electromagnetic waves.

A shield layer of the print circuit board 100 electromagnetically shields the areas between three pins penetratingly installed in the connector base 11. On a top surface (part mounted surface) of the print circuit board 100: a capacitor element that prevents invasion by high-frequency wave; and a Zener diode element that protects the circuit from being electrostatically destroyed (both of which are not shown in the figure) are mounted in parallel. The surface on which these parts are mounted is covered with the shield cover 200, therefore, the microphone is protected against radiation by high frequency waves.

In the invention disclosed in Japanese Patent Application Publication No. 2005-311752, the shield cover 200 is in contact with the microphone case to protect the connector base 11 against invasion by electromagnetic waves. However, at only one point of a side opposite to the position of the connector base 11 at which the male thread 12 is screwed in, an outer periphery of the connector base 11 and an inner periphery of the cylindrical connector housing 20 are in line contact via the shield cover 200. Thus, the shield cover 200 and the cylindrical connector housing 20 are not in stable contact. On the side at which the male thread 12 is screwed in the connector base 11, a part of the shield cover 200 may be pressed against the inner surface of the cylindrical connector housing 20 with a flange (a shoulder) of the male thread 12. The part of the shield cover 200 may be pressed against the inner surface of the cylindrical connector housing 20 with the flange (the shoulder) of the male thread 12. Unfortunately, in this case, the shield cover 200 may be partly turned up to make the contact between the shield cover 200 and the cylindrical connector housing 20 less stable. Therefore, the invention disclosed in Japanese Patent Application Publication No. 2005-311752, which can provide the shielding effect, requires improvement. Moreover, a slight movement of the connector portion as a result of repeated putting on and pulling out of the microphone cord makes the contact less stable. With the less stable contact therebetween, a high frequency wave may not be blocked.

SUMMARY OF THE INVENTION

In view of the above, an object of the present invention is to provide a microphone output connector that can make the contact between the shield cover and the cylindrical connector housing stable so that electromagnetic waves can be more effectively blocked even if the microphone cord is repeatedly put on and pulled out or the connector moves within the microphone case.

An aspect of the present invention is a microphone output connector of a three-pin type having a connector base made of an electric insulator, and a first pin for earthing, a second pin and a third pin for signals, which are penetratingly installed in the connector base, the connector base being installed in a cylindrical connector housing and fixed therein by making a thread screwed in the connector base contact with the cylindrical connector housing. The microphone output connector includes: a shield cover penetrated by the three pins and covering a surface of the connector base. The cylindrical connector housing and the first pin are installed at an end of a conductive microphone case of a microphone to be electrically connected to the microphone case. The shield cover partly extends to cover a portion of the connector base at which the thread is screwed in so that, the shield cover is pressed against an inner surface of the cylindrical connector housing by the thread. The shield cover is pressed against the inner surface of the cylindrical connector housing by the connector base at a side of the connector base opposite to the position at which the thread is screwed in.

With the present invention, a thread pulled out from an opening pushes up a shield cover from inside a connector to make the shield cover and a microphone case stably contact with each other at a plurality of positions. Thus, the contact between the shield cover and the microphone case is stable even if putting on and pulling out of the microphone cord is repeated or a connector moves within the microphone case while protecting a microphone against radiation by high-frequency waves from a wiring leading to a capacitor.

DETAILED DESCRIPTION OF THE PREFERRED EMBODIMENTS

An embodiment of the present invention will be described with reference to the accompanying drawings.

Figure 1:
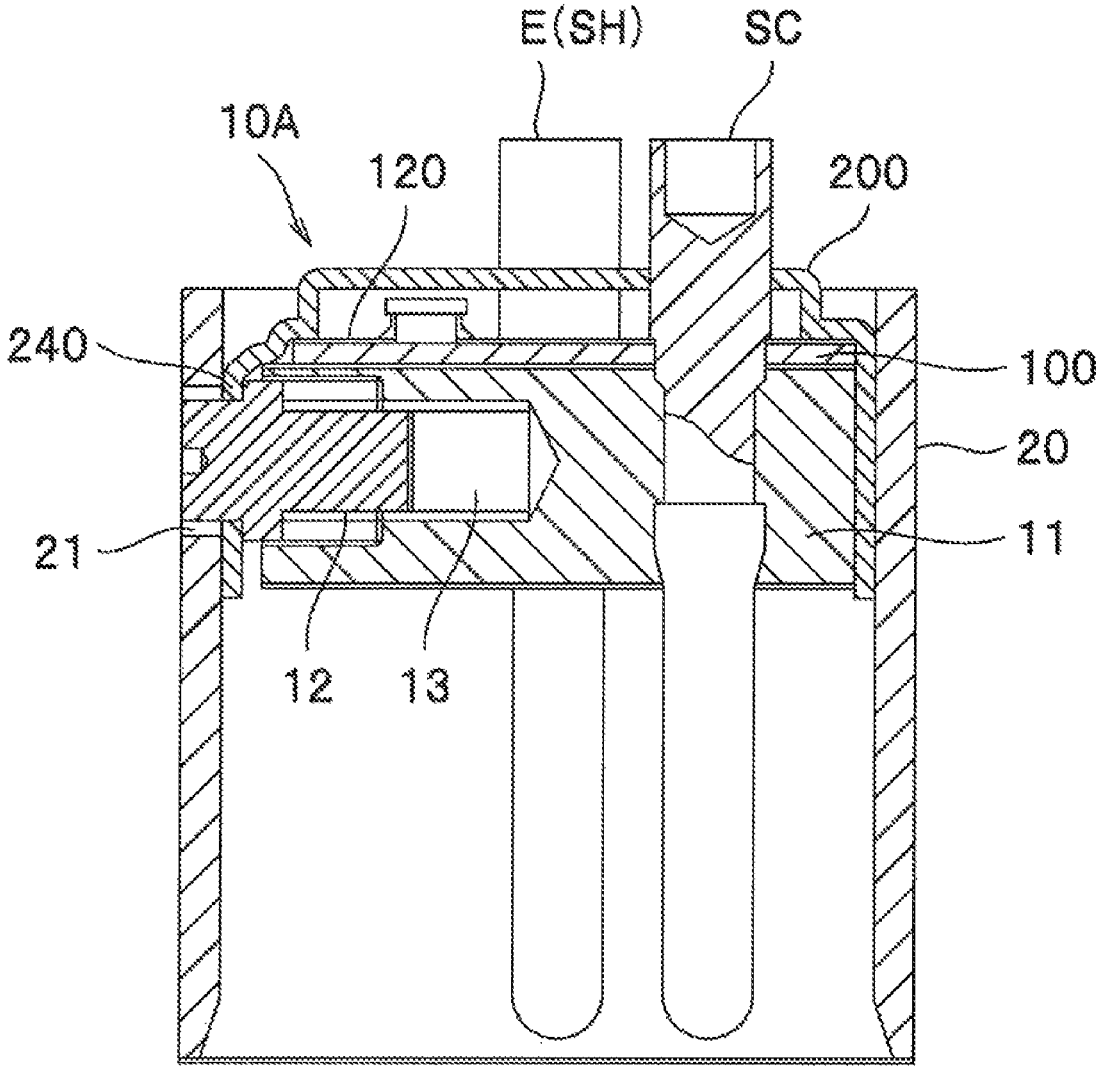
FIG. 1 is a cross-sectional view of an output connector according to an embodiment of the present invention installed in a cylindrical connector housing of a microphone.

As shown in FIG. 1, an output connector 10A includes: a connector base 11; a male thread 12 for fixing; a print circuit board 100; a shield cover 200; and a thread housing hole 13. A peripheral wall of the cylindrical connector housing 20 has a round hole 21 for inserting a screwdriver. A head of the male thread 12 for fixing screwed in the connector base 11 is placed in the round hole 21.

Figure 2:
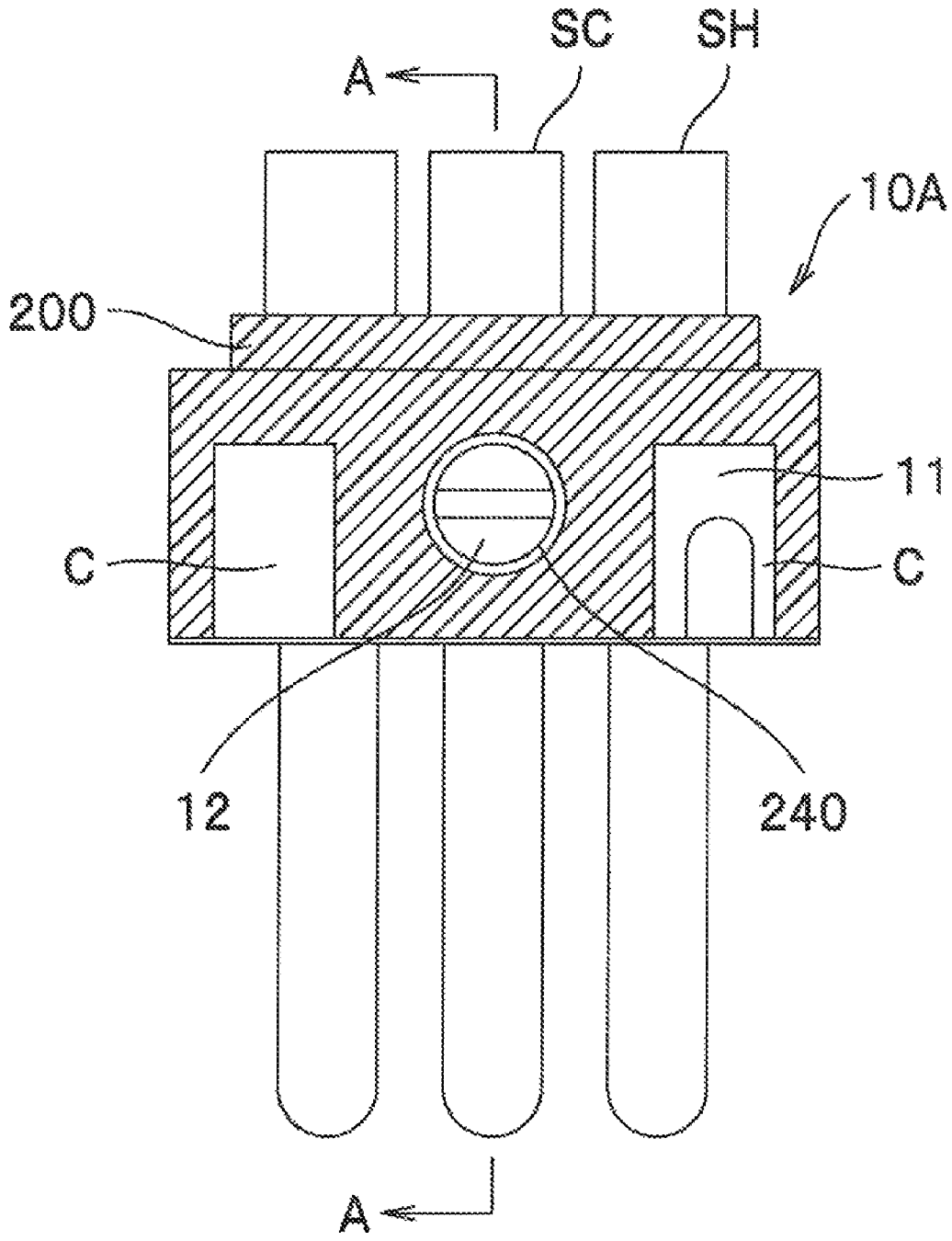
FIG. 2 is a front view of the output connector according to the embodiment of the present invention.

FIG. 2 is a front view of the output connector 10A. As described above, the output connector 10A includes: the connector base 11; the male thread 12 for fixing; and the shield cover 200. The shield cover 200 has a round shape concentric to an end surface of the connector base 11. The shield cover 200 also has a shape of an inverted cup having a round hole 240 on its peripheral wall. FIG. 1 is a cross sectional view of the output connector taken along the line A-A in FIG. 2. Thus, in FIG. 1, a second pin SH on a hot signal side is placed closer to the reader than a first pin E for earthing as viewed in the figure.

In FIG. 1, the shield cover 200 covers: a top surface 120 of the print circuit board 100 with an appropriate space therebetween and; aside surface of the connector base 11 formed in a column shape as shown in FIG. 1. The connector base 11 is made of an electric insulator. The connector base 11 is fixed in the cylindrical connector housing 20 by: installing the connector base 11 in the cylindrical connector housing 20; rotating and pulling up the male thread 12 screwed in the connector base 11; and making a flange (a shoulder) of the male thread 12 and the cylindrical connector housing 20 contact with each other. The shield cover 200 is partly extended to cover the portion at which the male thread 12 is screwed in the connector base 11 and has the round hole 240 at a position corresponding to the head of the male thread 12. A peripheral portion of the round hole 240 is pressed by the flange (the shoulder) of the male thread 12. Thus, the male thread 12 is pressed against the inner surface of the cylindrical connector housing 20 via the peripheral portion of the round hole 240. The first pin E for earthing, the second pin SH on the hot signal side, and a third pin SC on a cold signal side are penetratingly installed in the connector base 11. The shield cover 200 also penetrated by the three pins covers a surface of the connector base 11.

The male thread 12 is pulled out from the connector base 11 by being rotated by a screwdriver and the like (not shown) inserted through the round hole 21 of the cylindrical connector housing 20. The shield cover 200 is pressed against the cylindrical connector housing 20 from inside with the flange (a shoulder) of the male thread 12 so that the contact between the cylindrical connector housing 20 and the shield cover 200 is stable. Moreover, the flange (the shoulder) of the male thread 12 applies pressure to press the peripheral portion of the round hole 240 formed in the shield cover 200 to the inner periphery of the cylindrical connector housing 20. The pressure also makes the shield cover 200 contact with the cylindrical connector housing 20 at the side that is opposite to the position at which the male thread 12 and the cylindrical connector housing 20 are in contact with each other. Thus, the shield cover 200 and the cylindrical connector housing 20 are stably in contact with each other at a plurality of positions. Therefore, even if the microphone cord is repeatedly put on or pulled out or the output connector 10A moves within the microphone case, the stable contact between the shield cover 200 and the microphone case is maintained. Moreover, the microphone can be protected against radiation of high frequency waves generated by a cellular phone and the like.

As shown in FIG. 2, the round hole 240 of the shield cover 200 has a diameter larger than that of the head of the male thread 12 and smaller than that of the flange (the shoulder) of the male thread 12. Therefore, as the male thread 12 is pulled out more from the connector base 11, pressure applied from the flange (the shoulder) of the male thread 12 to press the shield cover 200 to the inner periphery of the cylindrical connector housing 20 increases. Thus, the shield cover 200 and the cylindrical connector housing 20 are stably in contact with each other. The shield cover 200 may be made of any materials or processed by any method as long as high-frequency electromagnetic waves can be blocked therewith. For example, the shield cover 200 may be a pressed-molded metal sheet. Similarly, the shield cover 200 may have any shape as long as electromagnetic waves and the like can be blocked therewith. In the example shown in FIG. 2, the shield cover 200 has rectangular cuts C on both sides of the portion at which the round hole 240 is drilled so as to facilitate deformation of the shield cover 200 upon receiving pressure from the male thread 12.

Figure 3A:
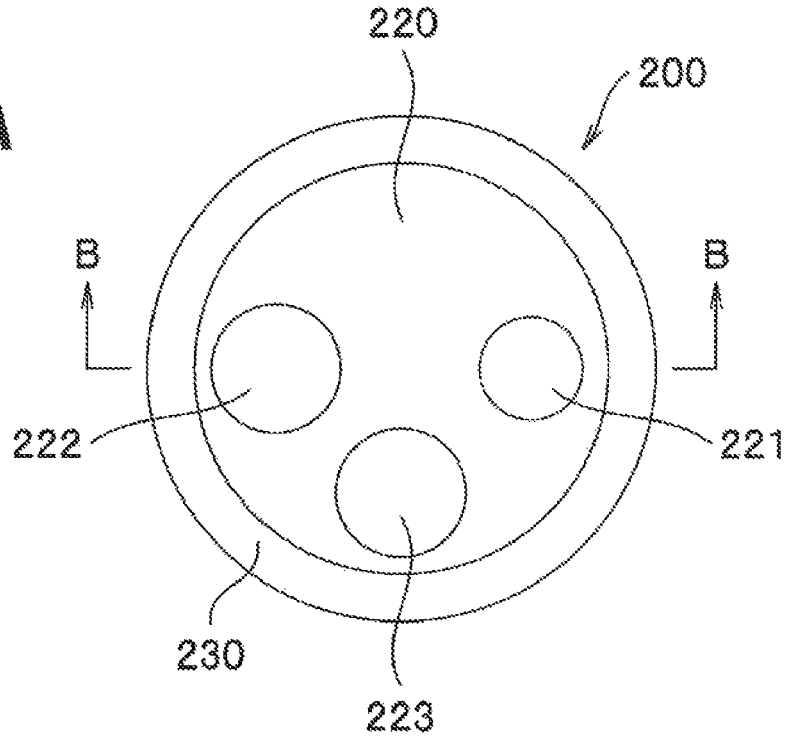
FIG. 3A is a bottom, view of a shield cover for the output connector.
Figure 3B:
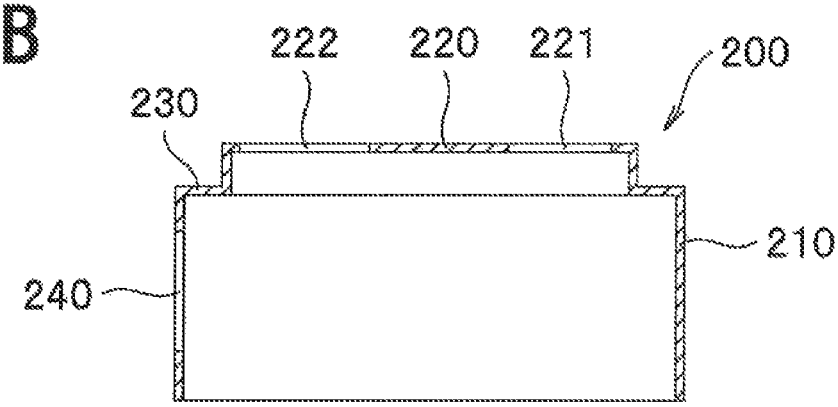
FIG. 3B is a cross-sectional view of the shield cover for the output connector.

As shown in FIGS. 3A and 3B, the shield cover 200 includes: a skirt 210 that fits the circumference of the print circuit board 100; a top plate 220 that covers the print circuit board 100; and the round hole 240 that allows the head of the male thread 12 to be rotate therein. The top plate 220 has pin through-holes 221, 222, and 223 through which the first pin E for earthing, the second pin SH on the hot signal side, and the third pin SC on the cold signal side respectively penetrate. A step portion 230 is installed between the skirt portion 210 and the top plate 220. The step portion 230 is formed by folding an upper end of the skirt portion 210 almost orthogonally inward.

Figure 4A:
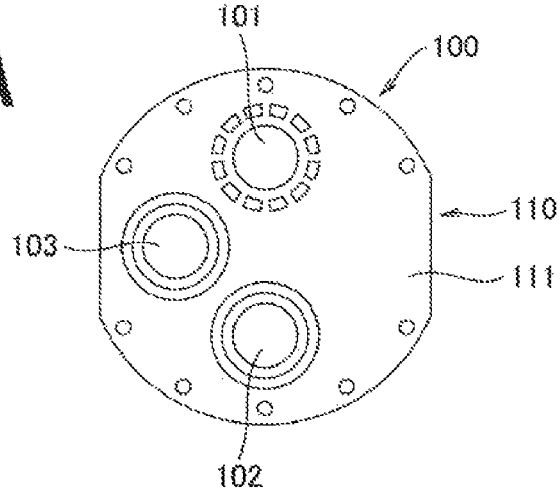
FIG. 4A is a bottom plan view of a print circuit board for the output connector.
Figure 4B:
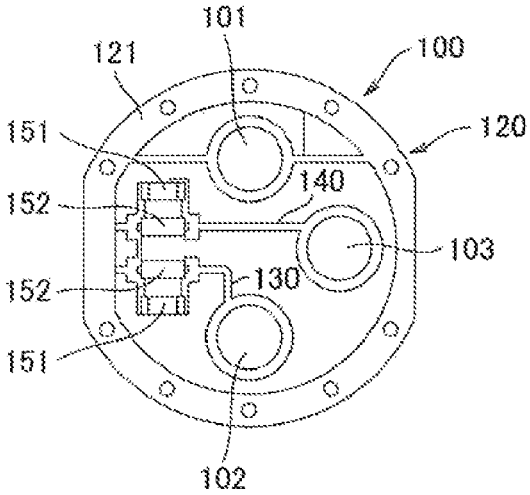
FIG. 4B is a top view of the print circuit board for the output connector mounted with circuit elements.
Figure 4C:
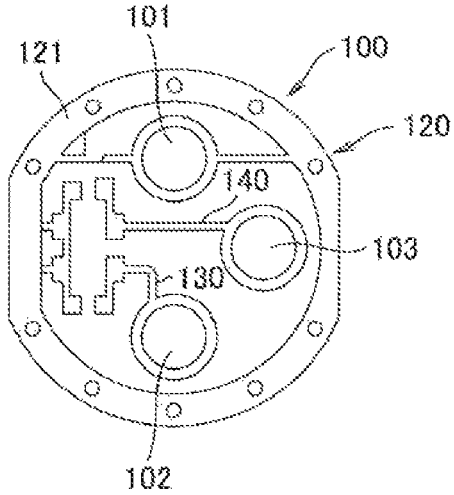
FIG. 4C is a top view of the print circuit board for the output connector before mounted with the circuit elements.
Figure 5:
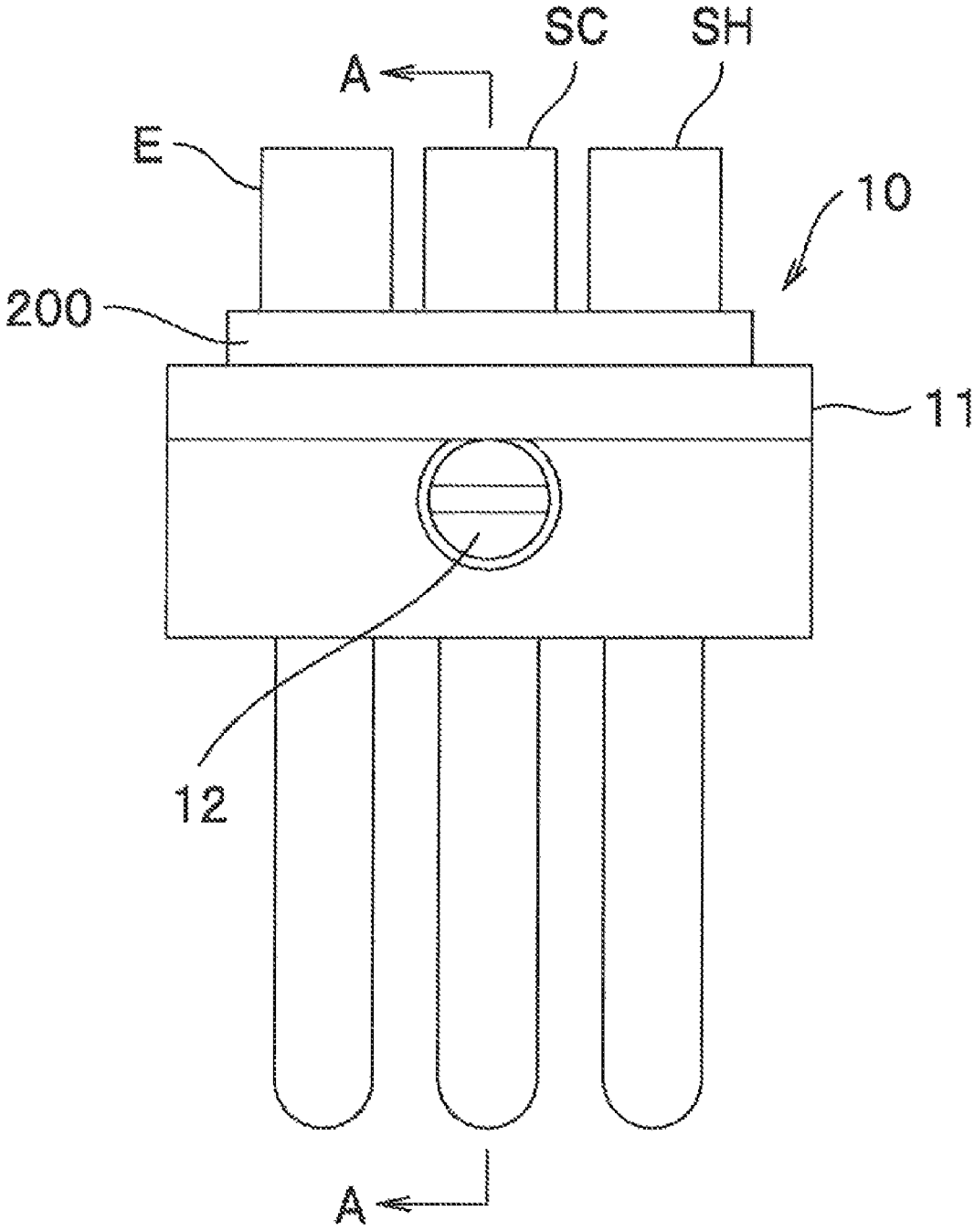
FIG. 5 RELATED ART
FIG. 5 is a front view of a conventional output connector.
Figure 6:
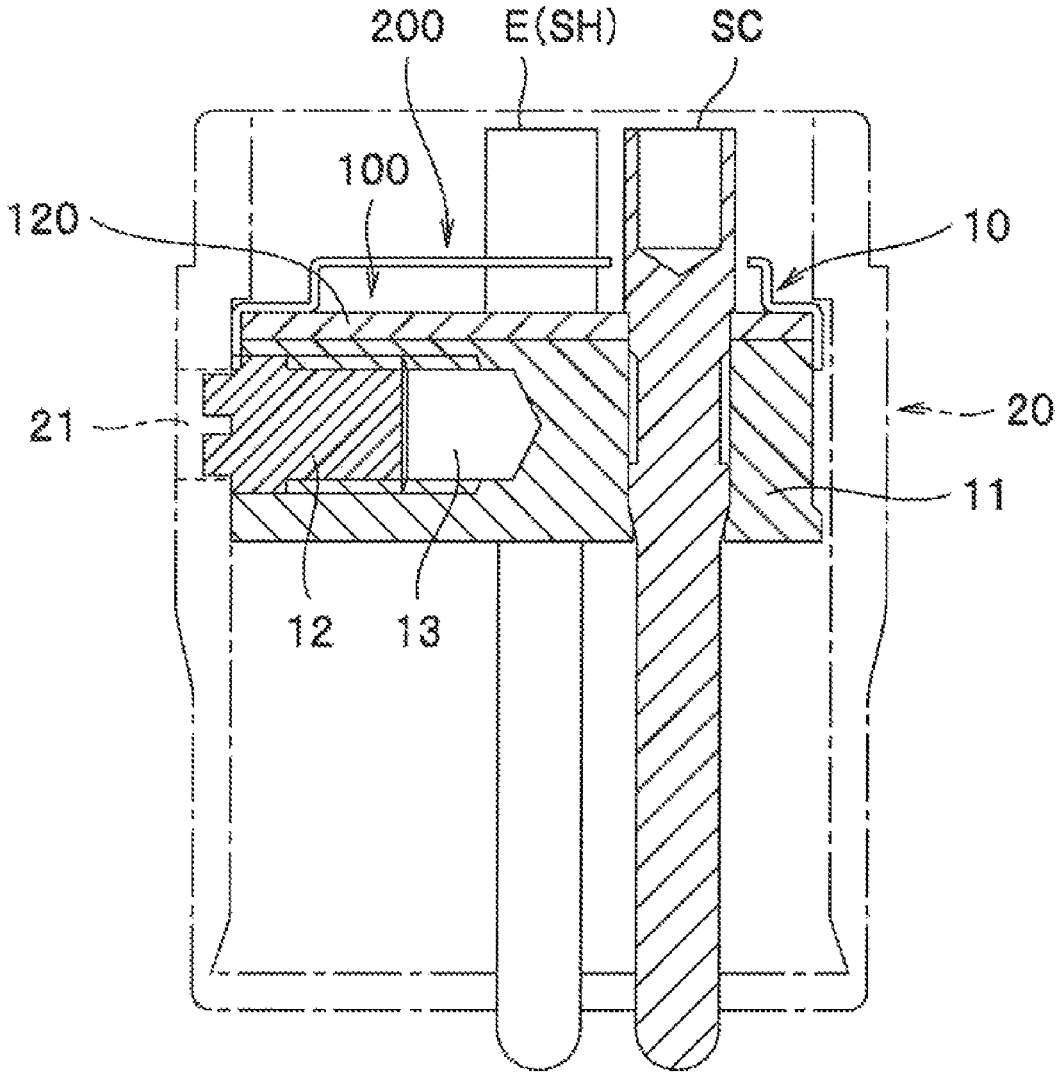
FIG. 6 RELATED ART
FIG. 6 is a cross-sectional view of the conventional output connector installed in a cylindrical connector housing.

Upon covering the print circuit board 100 with the shield cover 200, the step-portion 230 and a shield electrode 121 of the print circuit board 100 shown in FIGS. 4A, 4B, and 4C are in contact with each other. Thus, a shield layer 111 and the shield cover 200 are connected together so as to provide a low impedance. As a result, by covering a top surface 120 that is a part mounted surface of the print circuit board 100 with the shield cover 200, the microphone is protected against radiation of high-frequency waves generated from a wiring leading to capacitor elements 151. Preferably, the sizes of the pin through-holes 221 to 223 are set to be minimum required to draw the respective pins out of the through-holes.

In the example shown in FIGS. 4A to 4C, the print circuit board 100 is a double sided board. FIG. 4A depicts a pattern on a bottom surface 110 that faces the inner surface of the connector base 11. FIGS. 4B and 4C depict a pattern on the top surface 120 as the surface on which the parts are mounted. FIG. 4B depicts a state in which the capacitor elements 151 and Zener diode elements 152 are mounted. FIG. 4C depicts a state before the capacitor elements 151 and the Zener diode elements 152 are mounted, thereby only depicting wiring patterns. As shown in FIGS. 4A to 4C, the print circuit board 100 includes first to third pin through-holes 101 to 103 through which the first pin E for earthing, the second pin SH on the hot signal side, and the third pin SC on the cold signal side respectively penetrate.

In FIG. 4A, the shield layer 111 is formed almost all over the bottom surface 110 of the print circuit board 100; the shield layer 111 is a solid pattern made of a copper foil. The shield layer 111 is formed all over the bottom surface 110 except for the periphery of the second pin through-hole 102 and third pin through-hole 103. With the shield layer 111, the microphone can be protected against radiation by electromagnetic waves through the area between the pins of the connector base 11 through, for example, a microphone cable (not shown).

The shield layer 111 is not electrically connected to the second pin SH or third pin SC for signals but extends into the first pin through-hole 101 as a result of through-hole plating. Accordingly, the shield layer 111 is electrically connected to the first pin E for earthing. The interior of the second pin through-hole 102 and third pin through-hole 103 is through-hole-plated so as to be electrically connected to the pins SH and SC for signals.

In FIG. 4B, the capacitor elements 151 and the Zener diode elements 152 are mounted in parallel with the wiring patterns 130 and 140. As in the invention disclosed in Japanese Patent Application Publication No. 2005-311752, the capacitor elements 151 and the Zener diode elements 152, each of which are chip parts that can be mounted on a surface using an automatic machine, are respectively used to: prevent the invasion by high frequencies; and to protect the circuit from being electrostatically destroyed. In order to mount the capacitor elements 151 and the Zener diode elements 152 in parallel, the wiring patterns 130 and 140 preferably have a capacitor branch and a diode branch. When rush current flows to the shield electrode 121 due to intense electromagnetic waves, the capacitor elements 151 may be destroyed. In order to prevent this, for example, the wiring length of the capacitor branch is preferably designed to be larger than that of the diode branch so that the rush current flows first through the Zener diode elements 152 and then through the capacitor elements 151.

Details of the print circuit board 100 are similar to those of the invention disclosed in Japanese Patent Application Publication No. 2005-311752. Therefore, further description thereof is omitted. Note that the circuit formed on the print circuit board 100 is not limited to that described in Japanese Patent Application Publication No. 2005-311752 and can be formed as required. For example, the capacitor elements 151 and the Zener diode elements 152 can be disposed any where as long as the circuit can protect the microphone against invasion by electromagnetic waves.

The present invention is not limited to the preferred embodiment of the present invention described above. For example, the output connector using the shield cover 200 of the present invention can be used in a device other than the capacitor microphone explained as an example in the embodiment of the present invention. Further, the print circuit board 100 may not be installed, the pitch of the male thread 12 can be arbitrarily set, the male thread 12 may be rotated clockwise or counter clockwise, and the size of the male thread 12 can be arbitrarily set.

What is claimed is:

1. A microphone output connector of a three-pin type having a connector base made of an electric insulator, and a first pin for earthing, a second pin and a third pin for signals, which are penetratingly installed in the connector base, the connector base being installed in a cylindrical connector housing and fixed therein by making a thread screwed in the connector base contact with the cylindrical connector housing, the connector comprising:

a shield cover penetrated by the three pins and covering a surface of the connector base, wherein the cylindrical connector housing and the first pin are installed at an end of a conductive microphone case of a microphone to be electrically connected to the microphone case, the shield cover partly extends to cover a portion of the connector base at which the thread is screwed in so that the shield cover is pressed against an inner surface of the cylindrical connector housing by the thread, and the shield cover is pressed against the inner surface of the cylindrical connector housing by the connector base at a side of the connector base opposite to the position at which the thread is screwed in.

2. The microphone output connector according to claim 1 further comprising, at a surface of the connector base at the microphone case side, a print circuit board penetrated by the three pins, wherein the print circuit board is covered by the shield cover.

3. The microphone output connector according to claim 2, wherein a capacitor element that prevents an invasion by a high-frequency wave and a Zener diode element that protects a circuit from being electrostatically destroyed are mounted on a wiring pattern formed on the print circuit board.

4. The microphone output connector according to claim 2, wherein the print circuit board has a shield layer.

5. The microphone output connector according to claim 4, wherein a capacitor element that prevents an invasion by a high-frequency wave and a Zener diode element that protects a circuit from being electrostatically destroyed are mounted on a wiring pattern formed on the print circuit board.

6. The microphone output connector according to claim 4, wherein the print circuit board has, at a periphery of a surface facing the shield cover, a shield electrode electrically connected to the shield layer via an intra-through-hole wiring and the shield cover is connected to the shield layer via the shield electrode.

7. The microphone output connector according to claim 6, wherein a capacitor element that prevents an invasion by a high-frequency wave and a Zener diode element that protects a circuit from being electrostatically destroyed are mounted on a wiring pattern formed on the print circuit board.

* * * * *

UNITED STATES PATENT AND TRADEMARK OFFICE

CERTIFICATE OF CORRECTION

PATENT NO. : 8,066,531 B2
APPLICATION NO. : 12/649694
DATED : November 29, 2011
INVENTOR(S) : Kanatsu It is certified that error appears in the above-identified patent and that said Letters Patent is hereby corrected as shown below:

The Title Page is amended to add the following

Foreign Application Priority Data:

Japanese Patent Application 2009-010087 filed January 20, 2009

Signed and Sealed this
Seventeenth Day of January, 2012

David J. Kappos

David J. Kappos
*Director of the United States Patent and Trademark Office*